US007032355B1

(12) United States Patent
Gyure et al.

(10) Patent No.: US 7,032,355 B1
(45) Date of Patent: Apr. 25, 2006

(54) CHILD'S HANDRAIL

(76) Inventors: Jan C. Gyure, 28202 Gita St., Livonia, MI (US) 48154; Karen Hargis, 28202 Gita Ct., Livonia, MI (US) 48154

( * ) Notice: Subject to any disclaimer, the term of this patent is extended or adjusted under 35 U.S.C. 154(b) by 344 days.

(21) Appl. No.: 10/628,697

(22) Filed: Jul. 28, 2003

Related U.S. Application Data

(60) Provisional application No. 60/403,809, filed on Aug. 16, 2002.

(51) Int. Cl.
*E04F 11/00* (2006.01)

(52) U.S. Cl. ..... 52/184; 52/726.1; 256/67; 403/389; 403/396

(58) Field of Classification Search ..... 52/182, 52/184, 726.1; 24/16 PB; 403/177, 385, 403/389, 396; 256/21, 1, 59, 67

See application file for complete search history.

(56) References Cited

U.S. PATENT DOCUMENTS

| | | | | |
|---|---|---|---|---|
| 4,556,201 | A | 12/1985 | Turner | |
| 4,948,100 | A | 8/1990 | Stevens | |
| 5,337,528 | A | 8/1994 | Jaworski et al. | |
| 5,853,166 | A | 12/1998 | Koza | |
| 5,966,781 | A * | 10/1999 | Geiger | 24/16 PB |
| 6,209,854 | B1 | 4/2001 | Sedlack et al. | |
| 6,364,257 | B1 * | 4/2002 | Holder | 248/74.3 |

* cited by examiner

*Primary Examiner*—Naoko Slack
(74) *Attorney, Agent, or Firm*—Charles W. Chandler

(57) ABSTRACT

A child's handrail assembly is mounted beneath another handrail and comprises three 6" dual pull-lock extension rods; a plurality of durable lightweight 1" diameter rods, which can be adjusted to fit any size handrail and connected together by an interlocking coupling. Each dual pull-lock extension rod includes an upper strap that is wrapped around the existing handrail and a lower strap that is wrapped around the lower rods to suspend the lower rods beneath the existing handrail and form a child's handrail.

8 Claims, 4 Drawing Sheets

CHILD'S HANDRAIL

CROSS-REFERENCE TO RELATED APPLICATION

This application claims priority of Provisional Patent Application filed Aug. 16, 2002, Ser. No. 60/403,809 for CHILD'S HANDRAIL.

BACKGROUND OF THE INVENTION

As children develop they become more independent, wanting to actually walk up and down the stairs like an adult, even if the adult does not feel they are ready. A family's main concern with young children and stairs in the home is the possibility of a child falling down the stairs. Child safety gates are used to prevent children from access to the stairs, but once the gate is opened the stairs are unsafe. The standard handrail is not positioned in a suitable height to accommodate children. Children in most danger of falling down the stairs are those in the zero-to-four year old age group; children of those ages seem to suffer the most severe injuries.

Handrails' for children are known in the prior art. Some have simple connections between the two rails, others are more complicated.

U.S. Pat. No. 6,209,854, issued on Apr. 3, 2001, to Mark A. Sedlack and William M. Miller, describes a suspended stair railing which uses four web-like connector brackets, each having a cylindrical body portion at the bottom and a broadened head portion at the top. The top of the connector bracket is attached to the existing handrail by a cable tie, and by screws to the lower rail. Sedlack requires no less than eight cable ties, eight screws, four connector brackets plus a plurality of tubes. Sedlack does not use releasable cable ties.

U.S. Pat. No. 5,853,166, issued on Dec. 29, 1998, to Kim J. Koza describes a handrail assembly for children using clamping devices and telescoping rods. Several alternative embodiments are disclosed. However, each embodiment uses screws and many other components. Koza states his handrail assembly can be quickly disassembled. This is a cause for concern since a child may find it easy to disengage the child's handrail assembly.

U.S. Pat. No. 5,337,528, issued on Aug. 16, 1994, to Frank Jaworski, Sabrina Jansen and Wayne Jaworski describes a child assist rail and support system which uses a rigid suspension element, a flexible strap and a locking buckle. A cinching element at one end of the suspension element is operative to place tension on the suspension strap after it has been inserted through the buckle and the buckle operated to secure the strap. A channel into which an auxiliary rail is received is at the other end of the suspension element. The strap is positioned around the auxiliary rail and into the buckle such that when the buckle is operated to tighten the strap around the handrail and auxiliary rail, the cinching element places tension on the strap. The buckle requires a setscrew to operate and maintain the strap in a fixed relationship with the buckle.

Jaworski et al. requires several components such as a cinching element and operational buckle for tightening and placing tension on the strap, and also requires screws to carry out the invention.

U.S. Pat. No. 4,948,100, issued on Aug. 14, 1990, to Larry L. Stevens describes a stair rail for toddlers that uses heart-shaped mounting brackets that are secured to the flight of stairs by the use of bolts and screws. Stevens does not attach to a standard mounted handrail. He uses mounting brackets, bolts and screws to carry out the invention which will require repairing the screw holes when the stair rail is removed.

U.S. Pat. No. 4,556,201, issued on Dec. 3, 1985, to Robert M. Turner describes a handrail for toddlers using a set of elongated rails and support brackets which are permanently connected to the mounted handrail and the lower handrail using a flat metal plate, screws or bolts. Turner is complicated, requiring the removal of the existing handrail in order to be installed and disassembled. The use of screws or bolts will cause damage to the existing handrail and will require repairing the holes when removed.

There is a need for an improved child's handrail that uses an all-inclusive rail coupling arrangement that is stronger, easy to affix and does not require the use of bolts, screws or brackets.

Therefore, there remains in the art a need for an improved child's handrail to assist children when ambulating the stairs.

SUMMARY OF THE INVENTION

It is an object of the present invention to use dual pull-lock extension rods linking the existing handrail and a lower child's handrail to assist a child when ambulating the stairs. The child's handrail rods are 1" in diameter, lightweight and adjustable to fit the length, width and shape of a standard mounted stair rail by simply using additional interlocking couplings and dual pull-lock extension rods, where necessary.

It is another object of the invention to provide a lower child's handrail that does not require the use of screws and will not damage or mar the existing standard mounted handrail and the wall.

It is therefore an object of the invention to provide a lower child's handrail that is attached to a standard handrail.

It is another object of the invention to have a releasable dual pull-lock extension rod for connecting the child's handrail to the existing handrail.

It is another object of the invention to use durable lightweight 1" diameter rods to allow a child to maintain a firm grasp to the lower child's handrail.

These and other objects, features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred Embodiment of the Invention with reference to the accompanying drawing figures, in which like reference numerals denote similar structure and refer to like elements throughout the several views, and in which.

DESCRIPTION OF THE PREFERRED EMBODIMENT OF THE INVENTION

Figure 1:
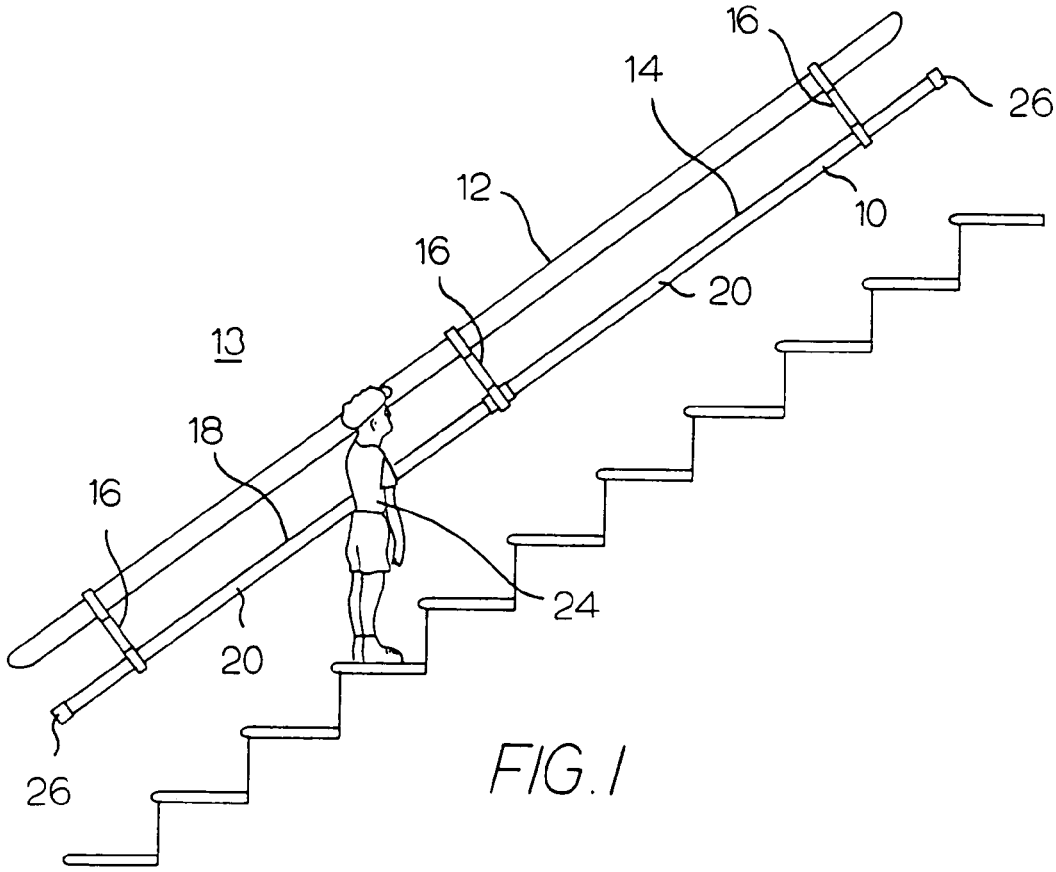
FIG. 1 illustrates the preferred embodiment of the invention attached to a standard mounted handrail, using a small child for scale.
Figure 2:
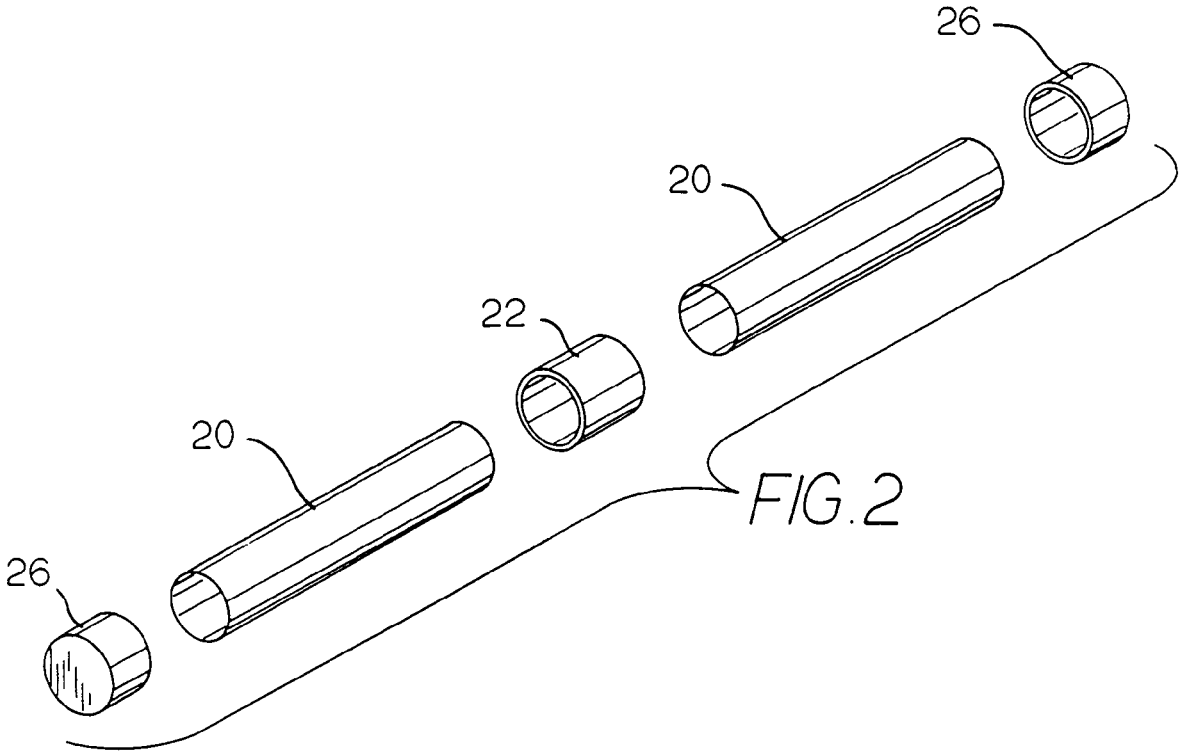
FIG. 2 is an exploded view of an interlocking coupling connecting two lightweight durable 1" diameter rods with safety caps at each end to form the preferred handrail.

FIG. 1 shows a preferred handrail assembly 10 adapted for connection to a permanent standard mounted handrail 12. Handrail 12 is mounted on a wall 13 by conventional supports, not shown. Handrail assembly 10 includes a child's handrail 14 suspended beneath standard handrail 12 so that there is 6" between the two rails.

Three dual pull-lock extension rods 16 are connected to handrail 12 to lower handrail 14 at three locations: top, middle and bottom. Handrail 18 comprises 2 rods 20. Each rod 20 is durable, lightweight, 1" in diameter of equal length and connected together by an interlocking coupling 22. A small child 24 is used for scale reference.

Safety caps 26 are mounted at each end of the assembled rods.

Figure 3:
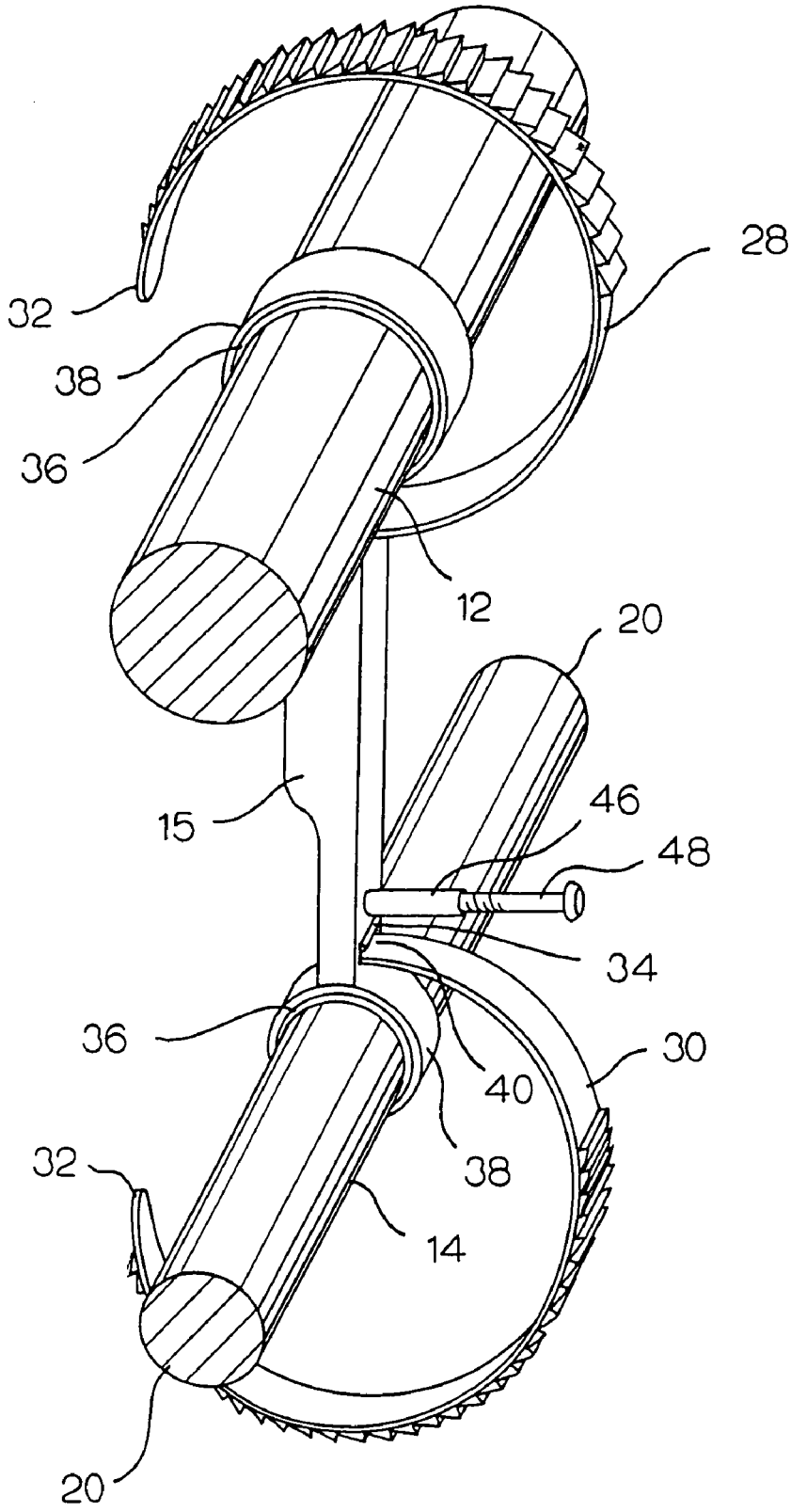
FIG. 3 is a pictorial front view of the 6" dual pull-lock extension rod secured to a standard mounted handrail and the lower child's handrail.
Figure 4:
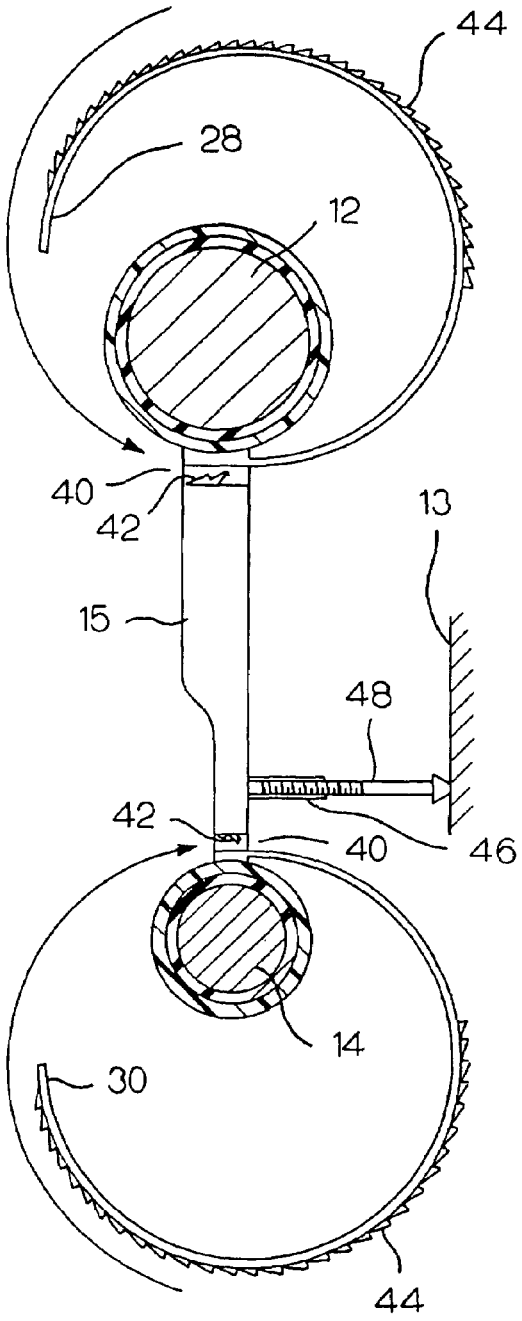
FIG. 4 is an enlarged view of the releasable release component.

FIGS. 3 and 4 show that the dual pull-lock extension rod 16, includes a pair of plastic, resilient pull-lock straps 28 and 30, each having a free end 32 and a locking mechanism 34 at the opposite end attached to an end of a rigid plastic post 15. Post 15 connects the two extension rods together. Rubber grip padding 36 and grip padding 38 are used between the standard mounted handrail 12, the lower handrail 14 and the pull-lock straps 24 at each of the attached locations.

In use, rubber grip padding 36 and grip padding 38 are wrapped around handrail 12 and lower handrail 14, at the locations mentioned above, in layers: one grip padding 38, then one rubber grip padding 36 disposed between the grip padding 38 and the handrail. Rubber grip padding 36 and grip padding 38, used in layers, make a secure bond between each of the straps and both handrail 12 and lower handrail 14.

The free ends 32 of the pull-lock straps 28 and 30 are encircled around padding 36 and 38 and inserted through a buckle opening 40 of the locking mechanism 34 and pulled until taut. Each pull-lock strap is prevented from being withdrawn from its respective locking position in the buckle opening by a resilient pawl 42 engaging teeth 44 formed on the outside surface of each strap.

A receptor 46 and an adjustable rubber tipped brace 48 mounted on the post are adjusted for contacting the wall at a suitable distance between the wall and the lower handrail.

By those skilled in the art, handrail assembly 10 can be easily assembled and installed. The lightweight durable 1" diameter rods 20 are connected by interlocking coupling 22, which telescopically receives the ends of the neighboring rods. Safety caps 26 are placed at each extreme end of rods 20 to form the lower handrail 14. Rubber grip padding 36 and grip padding 38, used in layers, are wrapped around the lower handrail 14 and the standard mounted handrail 12 at three locations: the top, middle and bottom. The free end 32 of each pull-lock strap is wrapped around padding 36 and 38 of the lower child's handrail 14 and handrail 12 and inserted through buckle opening until teeth 44 engage the pawl teeth 50, and pulled until tight. This is done at each of the previously mentioned locations to form lower handrail 14.

Figure 5:
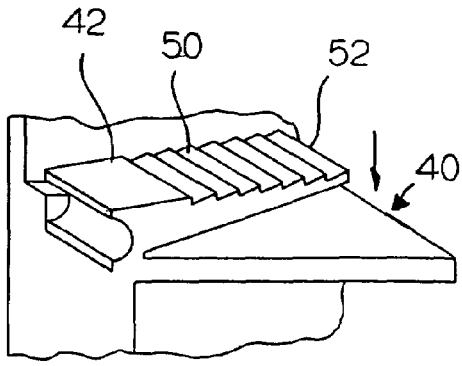
FIG. 5 is an enlarged view of one of the buckles.
Figure 6:
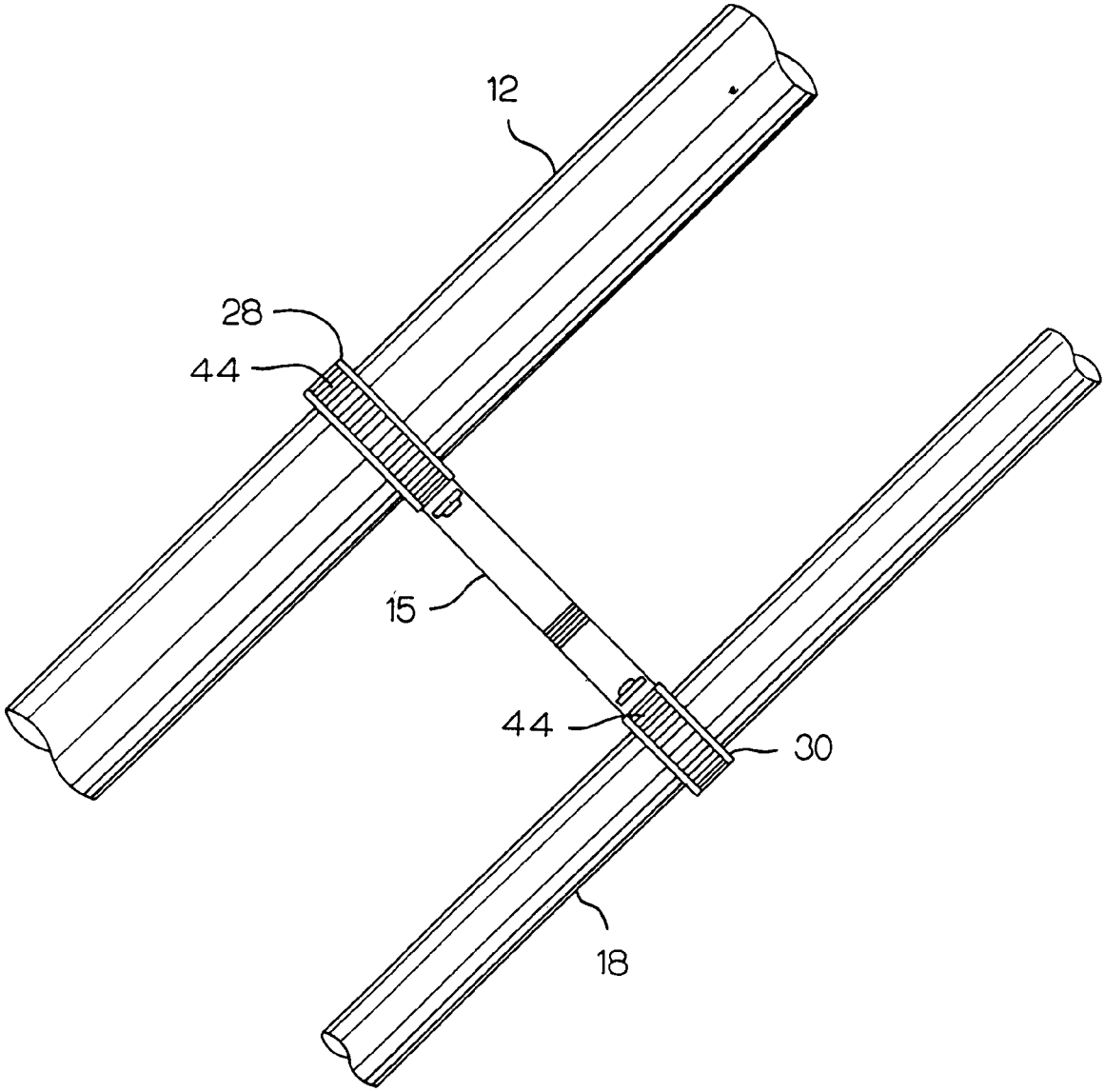
FIG. 6 is a view of a conventional handrail coupled to the preferred child's handrail.

Referring to FIG. 5, each of the pawls has a release tab 52 which may be depressed to separate the pawl teeth 50 from the strap teeth 44 when the child's handrail is being removed from the standard handrail.

Once installed, each receptor 32 with the adjustable rubber tipped brace 34 is then adjusted for a snug fit up against the wall.

Therefore, it can be seen that the objects of the invention have been satisfied by the structure presented above. While in accordance with the patent statues only the best mode and preferred embodiment of the invention has been presented and described in detail, the invention is not limited thereto or thereby. Accordingly, for an appreciation of the true scope and breadth of the invention reference should be made to the following claims.

Having described our invention, we claim:

1. A child's handrail assembly, comprising:

an elongated post having a first buckle-receiving opening at a first end thereof and a second buckle receiving opening at the opposite, second end thereof;

a resilient pawl mounted in each of said buckle-receiving openings and biased toward one side of their respective buckle-receiving openings and a strap-locking position, but movable against the bias of the panel toward an opposite side of the buckle-receiving opening and a strap-release position, the pawl having a tooth thereon;

a first strap having a first end attached to the first end of the post, and a free end receivable in the first buckle-receiving opening, the first strap having a series of teeth engageable with the pawl of the first buckle-receiving opening to define a first strap opening suitable for engaging a first handrail;

a second strap having a first end attached to the second end of the post, and a free end receivable in the second buckle-receiving opening, the second strap having a series of teeth engageable with the pawl of the second buckle-receiving opening to define a second strap opening suitable for engaging a second handrail in a position parallel to the first handrail position and separated according to the length of the post;

a handrail received in the second strap opening such that by pulling the free end of the second strap, the second strap tightly engages the circumference of the handrail.

2. A child's handrail assembly as defined in claim 1, including a tab carried on one end of the pawl and extending beyond the buckle-receiving opening of the pawl for moving the pawl toward said strap-release position.

3. A child's handrail assembly as defined in claim 1, including a second rail having one end thereof disposed adjacent an end of the first mentioned rail and a coupling for connecting one end of the first rail to an end of the second rail.

4. A child's handrail assembly as defined in claim 1, including padding disposed between the second strap and the handrail to prevent the handrail from sliding with respect to the strap.

5. A child's handrail assembly as defined in claim 1, in which the teeth on each of said straps are disposed on the opposite side of the strap with respect to the opening defined by the strap when the free end is connected to the post.

6. A child's handrail assembly as defined in claim 1, in which one end of each strap is attached to the post closely adjacent its' respective buckle-receiving opening.

7. A child's handrail assembly as defined in claim 1, including a cap mounted on each end of the handrail.

8. A child's handrail assembly, comprising:

an elongated post having a first buckle-receiving opening at a first end thereof and a second buckle receiving opening at the opposite, second end thereof;

a resilient pawl mounted in each of said buckle-receiving openings and biased toward one side of their respective buckle-receiving openings and a strap-locking position, but movable against the bias of the panel toward an opposite side of the buckle-receiving opening and a strap-release position, the pawl having a tooth thereon;

a first strap having a first end attached to the first end of the post, and a free end receivable in the first buckle-receiving opening, the first strap having a series of teeth engageable with the pawl of the first buckle-receiving opening to define a first strap opening suitable for engaging a first handrail;

a second strap having a first end attached to the second end of the post, and a free end receivable in the second buckle-receiving opening, the second strap having a series of teeth engageable with the pawl of the second buckle-receiving opening to define a second strap opening suitable for engaging a second handrail in a position parallel to the first handrail position and separated according to the length of the post;

a handrail received in the second strap opening such that by pulling the free end of the second strap, the second strap tightly engages the circumference of the handrail; and an elongated adjustable brace having one end connected to the post and an opposite end disposed to adjust to distance between the post and a wall on which an upper handrail is attached.

* * * * *